US005474045A

United States Patent [19]

Demizu et al.

[11] Patent Number: 5,474,045

[45] Date of Patent: Dec. 12, 1995

[54] ENGINE CONTROL DEVICE

[75] Inventors: Akira Demizu; Masakazu Sugai; Hitoshi Inoue; Ryoji Nishiyama; Hideaki Katashiba, all of Hyogo, Japan

[73] Assignee: Mitsubishi Denki Kabushiki Kaisha, Tokyo, Japan

[21] Appl. No.: 266,630

[22] Filed: Jun. 28, 1994

[30] Foreign Application Priority Data

Jun. 28, 1993 [JP] Japan ..... 5-156942

[51] Int. Cl.[6] ..... F02D 43/00

[52] U.S. Cl. ..... 123/418; 123/425; 123/435

[58] Field of Search ..... 123/418, 425, 123/435

[56] References Cited

U.S. PATENT DOCUMENTS

| | | | |
|---|---|---|---|
| 4,971,009 | 11/1990 | Washino et al. | 123/435 |
| 5,123,391 | 6/1992 | Ohkubo et al. | 123/435 |
| 5,245,969 | 9/1993 | Nishiyama et al. | 123/425 |

FOREIGN PATENT DOCUMENTS

| | | |
|---|---|---|
| 59-103965 | 6/1984 | Japan . |
| 59-221433 | 12/1984 | Japan . |
| 60-47836 | 3/1985 | Japan . |
| 1-253543 | 10/1989 | Japan . |

*Primary Examiner*—Andrew M. Dolinar

*Attorney, Agent, or Firm*—Sughrue, Mion, Zinn, Macpeak & Seas; Richard C. Turner; Marie-Claire Boisvert

[57] ABSTRACT

An engine control device comprises: crank angle sensor provided for the cylinders of an engine; cylinder internal pressure sensor for detecting the internal pressures of the cylinders according to the output signals of the crank angle sensor; pressure normalizing unit for normalizing the cylinder internal pressures thus detected, according to the cylinder internal pressure which is obtained when the engine is in standard state; engine speed detector; charge efficiency calculating unit for calculating the charge efficiencies of the cylinders by using the output signals of the pressure normalizing unit and the engine speed detector; operating condition detecting unit for detecting the outputs of the pressure normalizing unit and the engine speed detector as operating conditions, calculation control unit for calculating the air/fuel ratio and the ignition timing of each cylinder according to the operating conditions; and adjusting unit for adjusting the air/fuel ratios and ignition timing of the cylinders according to the output of the calculation control unit, thereby to control the air/fuel ratios and ignition timing of the cylinders with high accuracy.

9 Claims, 9 Drawing Sheets

ENGINE CONTROL DEVICE

BACKGROUND OF THE INVENTION

This invention relates to an engine control device which calculates fuel injection quantities, fuel injection timing, and ignition timing from the pressures in the combustion chambers of an engine (hereinafter referred to as "cylinder internal pressures", when applicable) to control the air/fuel ratio and the ignition timing of the engine.

An engine control device has been known in the art which detects the pressures in the combustion chambers of an engine to calculate the quantity of air sucked into the engine, thereby to detect the fuel injection quantity or ignition timing of the engine.

An example of the engine control device of this type has been disclosed, for instance, by Unexamined Japanese Patent Publication Hei-1-253543/(1989). The engine control device is as shown in FIG. 12.

In FIG. 12, reference numeral 61 designates an engine body. The detecting sections of a cylinder internal pressure sensor 62 and a cylinder internal temperature sensor 63 are provided on a cylinder head 61*a* in such a manner that they are exposed to the combustion chamber of the cylinder.

Injectors 64 are provided to suction ports 61*b* which are communicated with the cylinders of the engine body 61. The suction ports 61*b* are further communicated through a suction manifold 65 to a throttle chamber 66. The upstream side of the throttle chamber 66 is communicated through a suction pipe 67 with an air cleaner 68.

A timing sensor (or crank angle sensor) 610 for detecting predetermined crank angles for the cylinders is provided for a distributor 691 which is coupled to a cam shaft (not shown) of the engine body 61.

On the other hand, an air/fuel ratio sensor 611 is provided at the confluence of the exhaust manifold 6 communicated with the exhaust port 61*c* of the engine body 61.

Further in FIG. 12, reference numeral 612 designates a catalytic converter; 613, a throttle valve; 614, a control unit (hereinafter referred to as "an ECU 614", when applicable).

The ECU 614 is made up of a micro-computer including a CPU (central processing unit), a ROM (read-only memory), a RAM (random access memory), and an input interface. The input side of the ECU 614 is connected to the cylinder internal pressure sensor 62, the cylinder internal temperature sensor 63, the timing sensor 610, and the air/fuel ratio sensor 611. The output side of the ECU 614 is connected through a drive circuit 616 to the injectors 64, and connected through another drive circuit 617 to an ignition plug 615, which is disposed on the cylinder head 61*a*.

Now, a suction air quantity calculating method will be described.

The ECU 614 calculates a suction air quantity Ga for each cylinder, for instance, according to the following equation:

$$Ga=(P\times V)/(R\times T)$$

where P is the cylinder internal pressure which is read when, in the stroke of compression of each cylinder, a predetermined crank angle (for instance 90° before the top dead center (TDC) (hereinafter referred to as "BTDC 90°", when applicable)) is detected with the aid of the timing sensor 610; V is the combustion chamber internal volume detected when the predetermined crank angle is detected; R is the gas constant in the stroke of compression; and T is the cylinder internal temperature measured with the cylinder internal temperature sensor.

The above-mentioned Unexamined Japanese Patent Publication Hei-1-253543/(1989) states that, in the case where a suction air quantity is obtained from a cylinder internal pressure, it is impossible to eliminate the effect of the temperature of air sucked in a cylinder (hereinafter referred to as "a cylinder internal air temperature", when applicable) by using the cylinder internal pressure only, and therefore the cylinder internal air temperature is employed as one of the factors for calculating the suction air quantity.

On the other hand, an engine control device for calculating a suction air quantity from a cylinder internal pressure is available which is different from the above-described device in the method of calculating a suction air quantity.

For instance, an engine control device according to Unexamined Japanese Patent Publication Sho-59-221433/(1984) has disclosed the following method of calculating a suction air quantity: As shown in FIG. 14, a linear function is established between a charge air quantity Ga in the engine and a cylinder internal pressure difference ΔP (FIG. 13) which is the difference between the cylinder internal pressure detected with the bottom dead center (BDC) in the stroke of compression and that detected with 40° before the top dead center (BTDC 40°) in the same stroke. This linear function is utilized to calculate a suction air quantity by using the difference ΔP between the cylinder internal pressures which are detected with two different crank angles in the stroke of compression. In this case, unlike the aforementioned Unexamined Japanese Patent Publication Hei-1-1253543, it is unnecessary to refer to the cylinder internal air temperature.

On the other hand, Unexamined Japanese Patent Publication Sho-60-47836/(1985) has disclosed a method of determining fuel injection time from a two-dimensional map of fuel injection time which has been stored in a ROM in the ECU in advance. This method is able to compensate the variations in charge air quantity which, even with the cylinder internal pressure maintained unchanged, occur depending on the variations in speed of the engine.

The above-described calculation of a charge air quantity for the engine is performed by the ECU 614. The result of calculation is utilized to calculate a fuel injection pulse width according to the following equation:

$$Ti=K\times Ga\times KFB\times Ke$$

where K is the air/fuel ratio constant; KFB is the air/fuel ratio feedback correction data; and Ke is the correcting coefficient for correcting the fuel injection pulse width according to the cylinder internal temperature sensor or a cooled water temperature sensor.

Furthermore, Unexamined Japanese Patent Publication Sho- 59-103965/(1984) has disclosed the following technique: The absolute value of a cylinder internal pressure is measured with a crank angle of 40° after the bottom dead center (ABDC 40°), and for every operating condition which is determined by the cylinder internal pressure and the engine speed (rpm), the ECU operates to determine not only a fuel injection quantity but also ignition timing referring to a two-dimensional map of ignition timing predetermined therefor, and applies a signal to a drive circuit to drive the ignition coils thereby to control the ignition timing.

The conventional engine control device is designed as described above. That is, the suction air quantity is determined by using a cylinder internal pressure detected with a predetermined crank angle in the stroke of compression, or the difference between cylinder internal pressures detected with two different crank angles. Hence, when the engine's operating point changes, the detecting accuracy is lowered by the suction air pressure pulsation, as a result of which the air/fuel ratio control and the ignition timing control are also lowered in accuracy. Furthermore, in the engine control device, the above-described fuel injection control and ignition timing control are performed in the lump processing for all of the cylinders. Hence, in the case where the air quantities charged in the cylinders are varied being limited by the suction air passageways, the air/fuel ratios of the cylinders will greatly fluctuate.

SUMMARY OF THE INVENTION

Accordingly, an object of this invention is to eliminate the above-described difficulties accompanying a conventional engine control device.

More specifically, an object of the invention is to provide an engine control device which, even the engine's operating point changes, detects the air quantities charged in the cylinders, and independently controls the air/fuel ratio and the ignition timing for each of the cylinders with high accuracy.

To achieve the foregoing object of the invention, an engine control device for controlling an engine having a plurality of cylinders, comprises a crank angle sensor for detecting predetermined crank angles of the engine; a cylinder internal pressure sensor for detecting the internal pressures of the cylinders according to output signals provided by the crank angle sensor; a pressure normalizing unit for normalizing, according to a predetermined reference cylinder internal pressure, the cylinder internal pressures measured by the pressure sensor; engine speed sensor; unit for obtaining values corresponding to charge air quantities of the cylinders by using an engine speed detected by the engine speed sensor and the cylinder internal pressures normalized by the pressure normalizing unit; operating condition detecting unit for detecting the values thus obtained and the engine speed as operating conditions; calculation controller for calculating the air/fuel ratios and the ignition timing of the cylinders according to the operating conditions; air/fuel ratio adjusting unit for adjusting the air fuel ratio of the engine according to the air/fuel ratios calculated by the calculation control unit; and ignition timing adjusting unit for adjusting the ignition timing of the cylinders according to the ignition timing calculated by the calculation control unit.

In the engine control device, the cylinder internal pressure sensor detect the internal pressures of the cylinders of the engine according to the predetermined crank angles detected by the crank angle sensor. The cylinder internal pressures are normalized by using the cylinder internal pressure provided when the engine is in the predetermined standard condition. Hence, even when the engine operating point changes or the charge air quantities of the cylinders change, suitable cylinder internal pressures can be obtained. The cylinder internal pressures thus normalized, and the engine speed are utilized to obtain values corresponding to the charge air quantities of the cylinders. The values corresponding to the charge air quantities, and the engine speed are detected as operating conditions. The calculation control unit calculates an air/fuel ratio and ignition timing for each cylinder according to the operating conditions thus detected. The results of calculation are utilized by the air/fuel ratio adjusting unit to adjust the air/fuel ratios, and by the ignition timing adjusting unit to adjust the ignition timing.

DETAILED DESCRIPTION OF PREFERRED EMBODIMENTS OF INVENTION

Preferred embodiments of this invention, will be described with reference to the accompanying drawings.

First Embodiment

Figure 1:
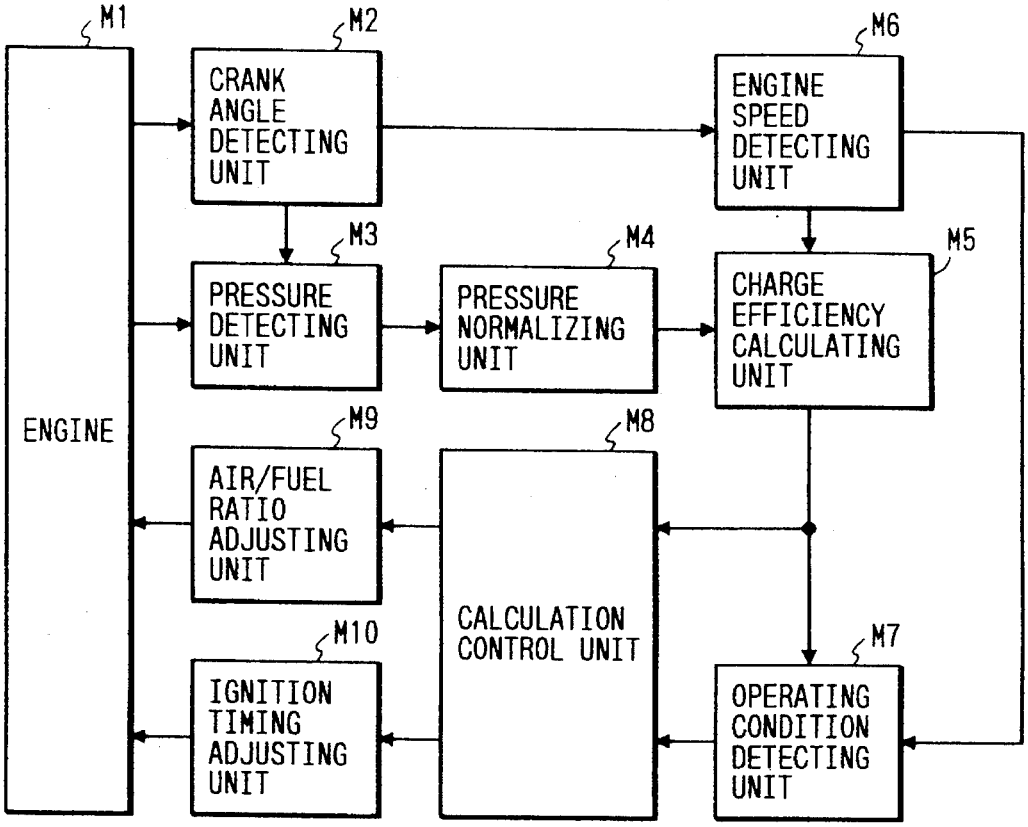
FIG. 1 is a block diagram showing the arrangement of an engine control device, which constitutes an embodiment of this invention.

An engine control device, which constitutes a first embodiment of the invention, is organized as shown in FIG. 1. That is, in FIG. 1, reference character M1 designates an engine with a plurality of cylinders; M2, crank angle detecting unit for detecting a crank angle of the engine M1; M3, pressure detecting unit connected to the combustion chambers of the engine M1, to measure cylinder internal pressures provided when predetermined crank angles of the cylinders are detected from the output signals of the crank angle detecting means M2; M4, pressure normalizing unit for normalizing, according to the reference cylinder internal pressure which is obtained when the engine M1 is in standard state, the cylinder internal pressures measured by the pressure detecting unit; M6, engine speed (rpm) detecting unit connected to the crank angle detecting unit M2, to detect the speed (rpm) of the engine M1 from the output signal of the crank angle detecting unit M2; M5, charge efficiency calculating unit for calculating air quantities charged in the cylinders by using the output signals of the pressure normalizing unit M4 and the engine speed detecting unit M6; M7, operating condition detecting unit connected to the engine speed detecting unit M6 and the charge efficiency calculating unit M5, to detect the operating condition of the engine M1 according to the output signals of those two unit M5 and M6; M8, calculation control unit for calculating the air/fuel ratio and the ignition timing of each cylinder according to the output signals of the operating condition detecting unit M7 and the charge efficiency calculating unit M5; M9, air/fuel ratio adjusting unit for adjusting the fuel injection quantity of the engine M1 according to an air/fuel ratio control signal provided by the calculation control unit M8, to adjust the air/fuel ratio of each cylinder; and M10, ignition timing adjusting unit for adjusting the ignition timing of each cylinder of the engine M1 according to an ignition timing control signal provided by the calculation control unit M8.

Figure 2:
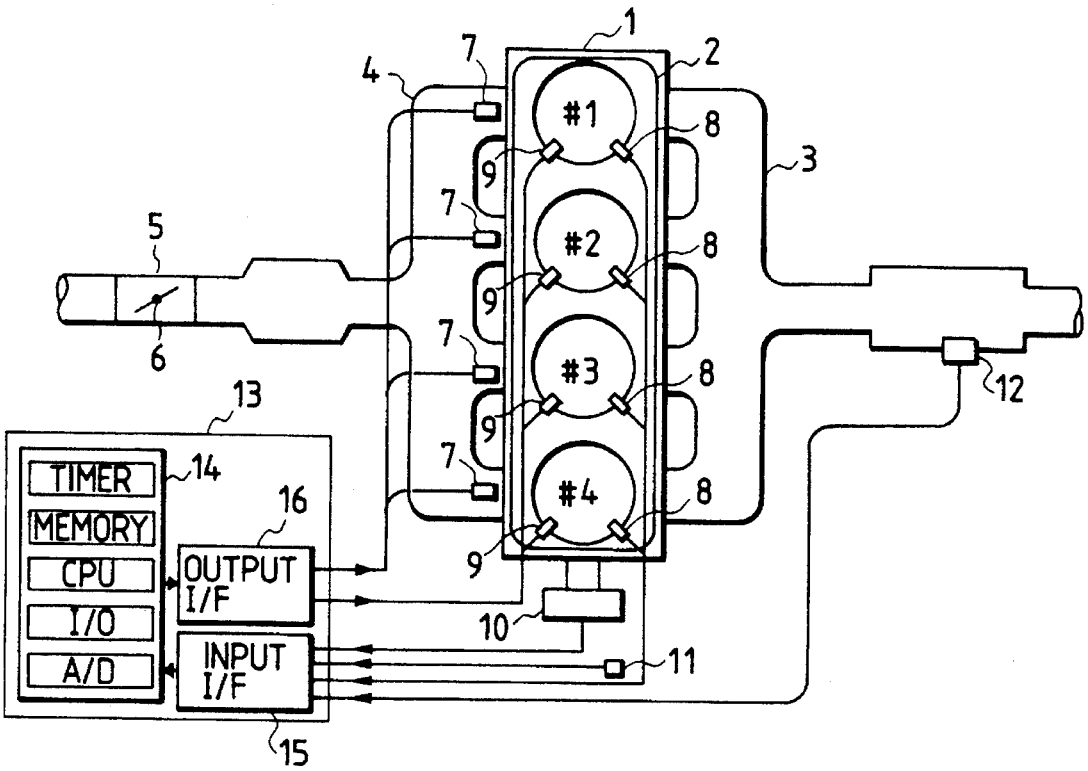
FIG. 2 is an explanatory diagram showing a concrete example of an engine according to the embodiment of the invention.

The engine control device shown in FIG. 1 may be realized as shown in FIG. 2.

In FIG. 2, reference numeral 1 designates an engine body with four cylinders #1, #2, #3 and #4. Those cylinders are provided with cylinder internal pressure sensors 8 and ignition plugs 9, respectively, which are arranged in the cylinder heads 2. The detecting sections of the cylinder internal pressure sensors 8 are exposed in the combustion chambers of the cylinders, respectively.

Injectors 7 are provided in the suction ports which are communicated with the cylinders of the engine body 1. The suction ports are further communicated through a suction manifold 4 to a throttle body 5, in which a throttle valve 6 is provided.

A crank angle sensor 10 is coupled to the crank shaft (not shown) of the engine body 1, to detect crank angles predetermined for the cylinders. The crank angle sensor 10 is adapted to output an unitary angle signal for every unitary crank angle (for instance 1°).

An air/fuel ratio sensor 12 is arranged on an exhaust manifold 3. A cylinder identifying crank angle sensor 11 is provided which operates in association with a cam shaft (not shown) in the cylinder head 2. The crank angle sensor 11 outputs a cylinder identifying signal and an ignition controlling ignition period signal for every crank angle reference position.

Further in FIG. 2, reference numeral 13 designates control means, namely, an ECU. The ECU 13 comprises: a micro-computer 14 including a CPU, a ROM, a RAM, an A/D (analog-to-digital) converter, and input and output terminals; an input interface 15 (hereinafter referred to as "an input I/F 15", when applicable) including a cylinder internal pressure signal input circuit which is adapted to amplify the output signal of each of the cylinder internal pressure sensors 8, and transmit it to the A/D converter in the micro-computer; and an output interface 16 (hereinafter referred to as "an output I/F 16", when applicable) for driving the injectors 7 and the ignition plugs 9 through ignition coils (not shown). The ECU 13 performs predetermined calculations according to the output signals of the cylinder internal sensors 8, the crank angle sensors 10 and 11, and the air/fuel ratio sensor 12, to detect the operating condition of the engine. In response to the operating condition thus detected, the ECU 13 applies fuel injection signals to the injectors 7 and ignition signals to the ignition plugs 9 through the output I/F 16, thereby to control the air/fuel ratios and the ignition timing of the cylinders.

Figure 3:
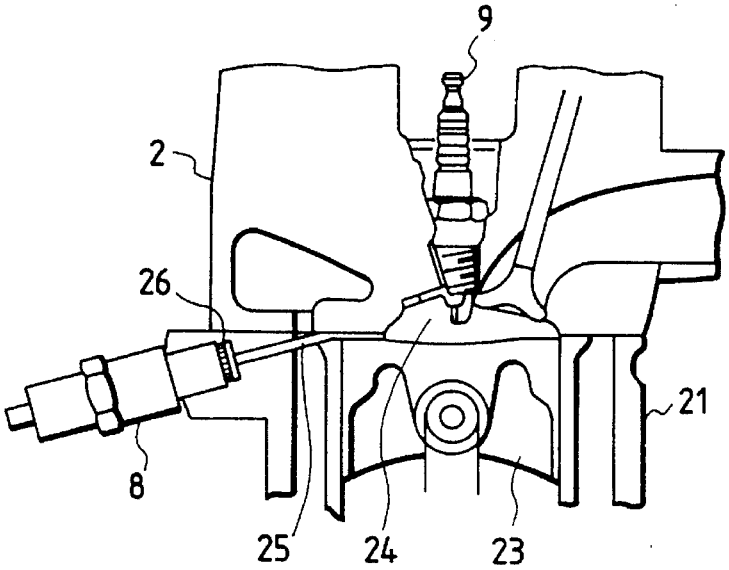
FIG. 3 is a fragmentary sectional view of a cylinder in an engine having cylinder internal pressure detecting means which is employed in the embodiment of the invention.

The cylinder internal pressure sensor 8 for detecting the pressure in the combustion chamber is arranged as shown in FIG. 3, which is a sectional view of a part of the engine body 1. In FIG. 3, parts corresponding to those which have been described with reference to FIG. 2 are therefore designated by the same reference numerals or characters.

In FIG. 3, reference numeral 2 designates the cylinder head; 21, a cylinder block; 23, a piston; 8, the cylinder internal pressure sensor. The cylinder internal pressure sensor 8 is connected to the cylinder block 21.

Further in FIG. 3, reference numeral 26 designates the pressure detecting section of the cylinder internal pressure sensor 8, which is exposed in a pressure leading section 25 which is communicated with the combustion chamber 24. The pressure detecting section 26 provides an output in proportion to a combustion pressure. More specifically, the pressure detecting section 26 is coupled to a pressure converting element (not shown) through a silicon oil or the like which is sealingly filled in a metal diaphragm, to measure the cylinder internal pressure. In the embodiment, the pressure converting element is a semiconductor pressure sensor; however, it may be made up of an piezo-electric element.

Now, an air/fuel ratio and ignition timing controlling principle according to the invention will be described.

Figure 4:
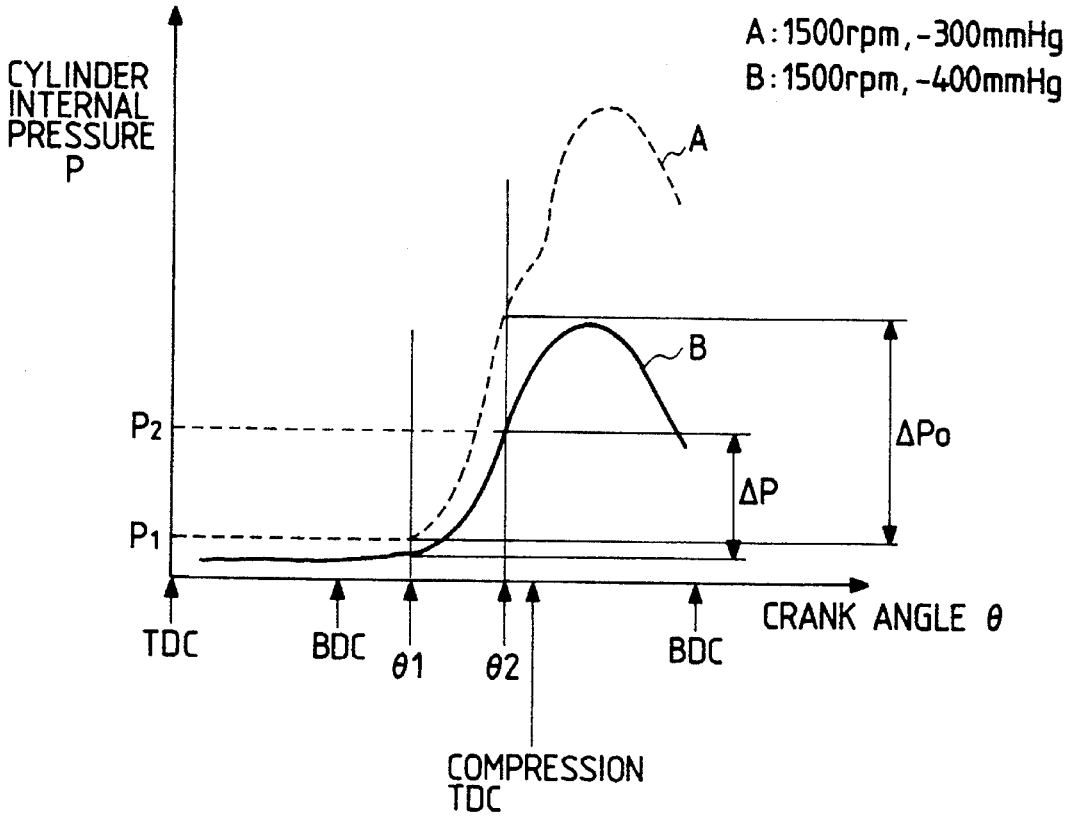
FIG. 4 is a graphical representation indicating relationships between crank angles and cylinder internal pressures in the stroke of compression.

FIG. 4 shows relationships between crank angles and cylinder internal pressures in a 4-stroke 4-cylinder engine. In FIG. 4, the curve "A" indicates cylinder internal pressures in the case where the speed of the engine is 1500 rpm, and the suction pipe pressure is −300 mm Hg; and the curve "B" indicates cylinder internal pressures in the case where the speed of the engine is 1500 rpm, and the suction pipe pressure is −400 mm Hg. Further in FIG. 4, reference characters $\theta_1$ and $\theta_2$ indicates predetermined crank angles in the stroke of compression. More specifically, the crank angle $\theta_1$ occurs after the suction valve is closed, —BTDC 90° for instance; and the crank angle $\theta_2$ occurs before the fuel is ignited, —BTDC 40° for instance.

If it is assumed that the cylinder internal pressure with the crank angle $\theta_1$ is represented by P1, and the cylinder internal pressure with the crank angle $\theta_2$ is represented by P2, then the difference ΔP between the cylinder internal pressures (hereinafter referred to as "a cylinder internal pressure difference ΔP, when applicable) is as follows:

$$\Delta P = P2 - P1 \quad (1)$$

Figure 14:
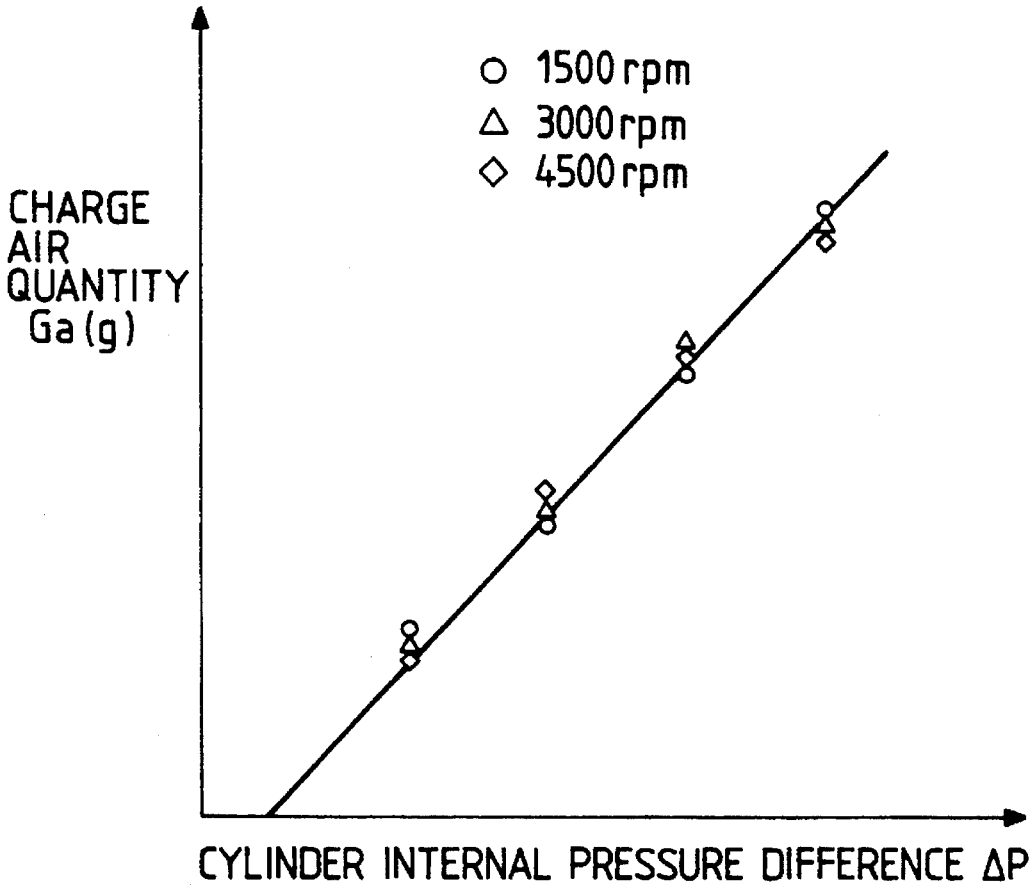
FIG. 14 PRIOR ART
FIG. 14 is a characteristic diagram indicating relationships between cylinder internal pressures and charge air quantities in the conventional engine control device.

A linear relation is established between the cylinder internal pressure difference ΔP and the charge air quantity Ga as shown in FIG. 14.

In the following description, instead of the charge air quantity Ga, a charge efficiency Ce will be employed. The charge efficiency Ce is the value which is obtained by dividing the weight of the air charged in the cylinder during the actual operation of the engine by the weight of the air charged in the cylinder which is in a standard state (for instance 1 atm and 0°). The charge efficiency Ce relates linearly to the cylinder internal pressure ΔP. Hence, the charge efficiency Ce can be obtained by measuring the cylinder internal pressure ΔP.

Figure 5:
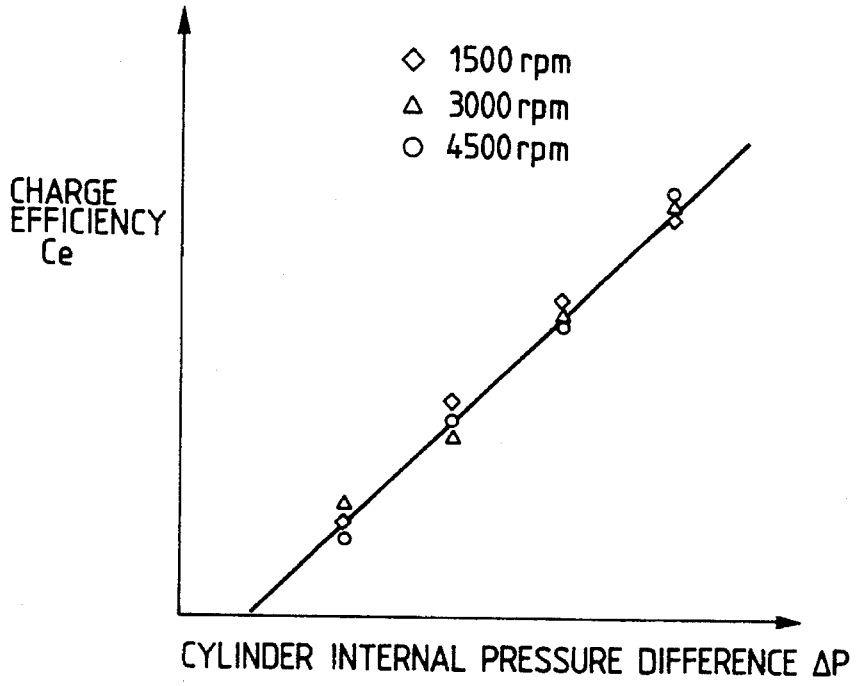
FIG. 5 is a graphical representation indicating cylinder internal pressure difference with charge efficiency.

However, as is apparent from FIG. 5, with one and the same the cylinder internal pressure ΔP, the charge efficiency Ce varies with the speed (rpm) of the engine. Furthermore, in this case, the absolute pressure values are employed for measurement. Hence, in the case where the cylinder internal pressure sensors provided for the cylinders are not sufficiently calibrated, the measurement of the charge efficiency Ce is low in accuracy.

Figure 6:
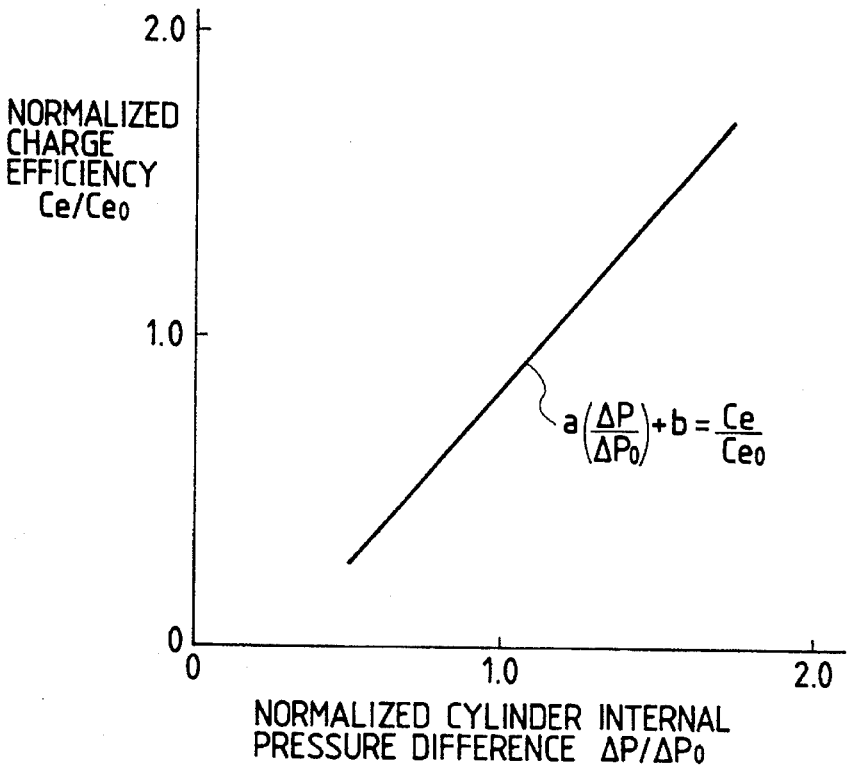
FIG. 6 is also a characteristic diagram indicating relationships between normalized cylinder internal pressures and charge efficiencies.

In order to eliminate this difficulty, the invention employs the following method: A reference load (for instance a suction pipe pressure of −300 mm Hg) is selected for every engine speed, to determine a normalized operating condition. Next, the engine is operated under this normalized operating condition, and a reference cylinder internal pressure difference ΔPo and a reference charge efficiency Ceo are measured. And, a cylinder internal pressure difference ΔP and a charge efficiency Ce measured when the engine operates under an optional operating condition are normalized with the aforementioned reference cylinder internal pressure difference ΔPo and reference charge efficiency Ceo, respectively, to obtain a linear function as shown in FIG. 6.

The normalized charge efficiency (Ce/Ceo) can be represented by the following Equation (2):

$$(Ce/Ceo)=a\times(\Delta P/\Delta Po)+b \quad (2)$$

The constants a and b of the Equation (2) are experimentally obtained by using the cylinder internal pressure difference ΔP and the engine speed (rpm). More specifically, the constants may be obtained according to the method of least square by using a cylinder internal pressure differences ΔP and a charge efficiencies Ce which are obtained with the operating condition changed, and by using a normalized reference cylinder pressure difference ΔPo and a normalized reference charge efficiency Ceo which are detected at an operating point predetermined for every engine speed (rpm).

Now, the operation of the embodiment will be described.

First, the relation between the crank angle sensor and the cylinder internal pressure will be described.

Figure 7:
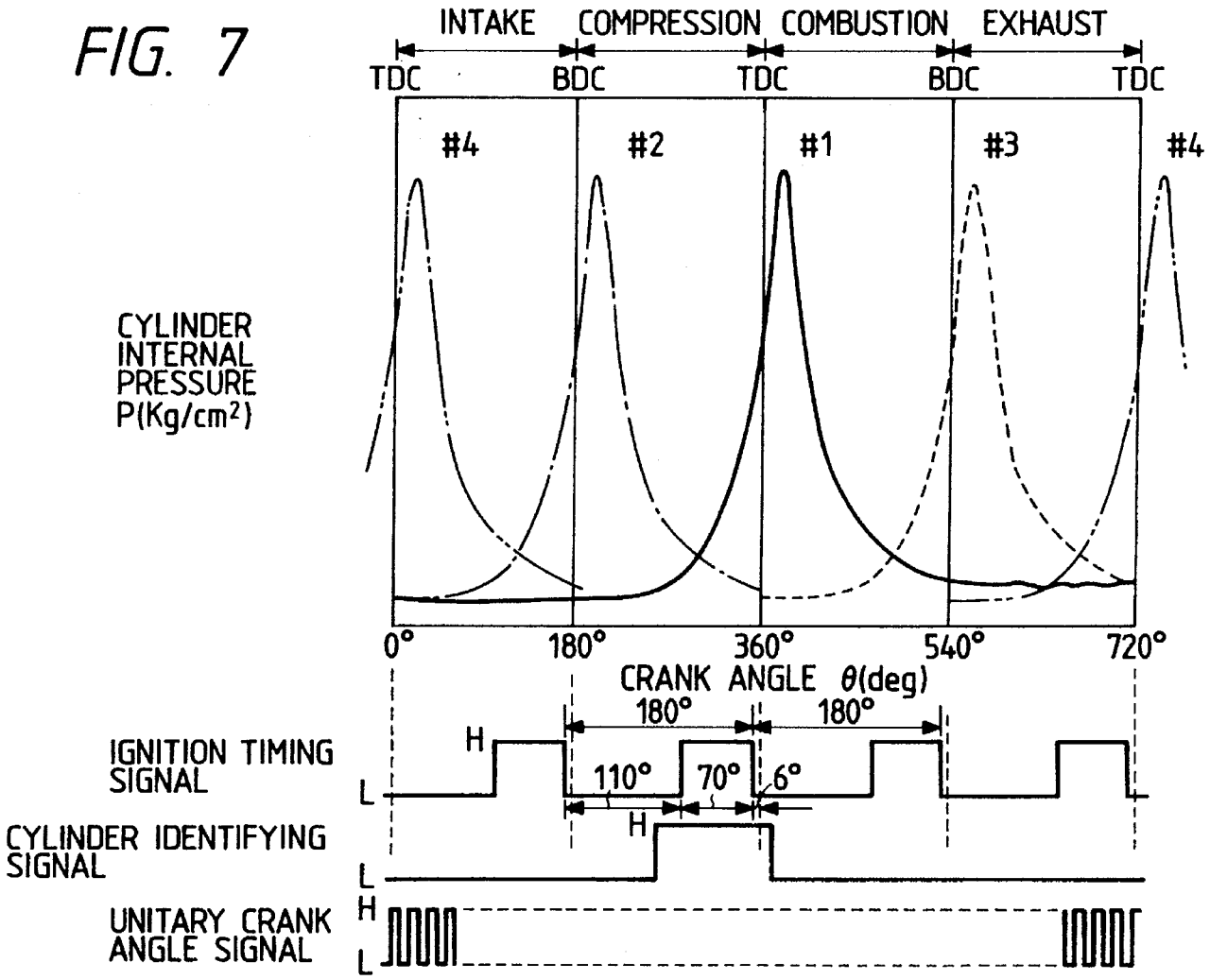
FIG. 7 is a time chart indicating the variations of cylinder internal pressures, an ignition timing signal, a cylinder identifying signal and a unitary crank angle signal with engine strokes.

The parts (a) through (d) of FIG. 7 show cylinder pressures and crank angle sensors' output signals with crank angles of a 4-stroke 4-cylinder engine.

In the part (a) of FIG. 7, the solid line indicates the pressure waveform of the first cylinder #1 of the engine 1, and reference character "BDC" means the bottom dead center, and reference character "TDC" means the top dead center. Further in the part (a) of FIG. 7, the broken line, the one-dot chain line, and the two-dot chain line indicate the pressure waveforms of the third, second and fourth cylinders #3, #2 and #4, respectively.

As is seen from FIG. 7, the combustion cycles of the cylinders are shifted by a crank angle of 180° from one another. In FIG. 7, for the first cylinder #1, intake, compression, combustion and exhaust strokes are shown; however, for simplification in illustration, for the remaining second, third and fourth cylinders, only the compression and combustion strokes are shown.

The crank angle sensor 11 outputs an ignition period signal which includes a low level interval of 110° (hereinafter referred merely to as "an L interval", when applicable) and a high level interval of 70° (hereinafter referred to merely as "an H interval", when applicable) which are obtained by dividing a period of 180° into two parts for instance with 6° before TDC as a reference, and an high level signal (H signal) in the interval of the ignition period signal which corresponds the H interval of the first cylinder as shown in the part (c) of FIG. 7; that is, a cylinder identifying signal for identifying the number of an ignition cylinder.

The crank angle sensor 10 outputs a unitary angle signal in which H and L levels occur alternately every unitary crank angle (one degree for instance) as shown in the part (d) of FIG. 7.

In general, the ignition control is carried out as follows: The cylinder identifying signal and the ignition period signal are utilized to control the energization of the ignition coils (not shown), thereby to ignite the gas in the cylinders. For instance, in the case of the first cylinder #1, the energization of the ignition coil is started during the H interval of the ignition period signal which corresponds to the stroke of compression between a crank angle of 180° and a crank angle of 360° of from crank angle, and the energization of the ignition coil is interrupted with the predetermined ignition timing when the level of the ignition period signal changes from high (H) to low (L) near the top dead center (TDC), as a result of which a high voltage is produced by the ignition coil. The high voltage thus produced is applied to the ignition plug 9 to ignite the gas in the cylinder.

As indicated by the solid line in FIG. 7, in the combustion stroke between crank angles of 360° and 540°, ignition occurs with the cylinder, and the combustion pressure is increased. Similarly, the combustion cycle is repeated with a period of 180°; that is, ignition occurs repeatedly with the cylinders #1, #3, #4 and #2 in the stated order.

In the fuel control, with the timing that the ignition period signal changes from L to H in correspondence to the intake stroke between crank angles of 0° and 180°, a valve opening time signal corresponding to a predetermined fuel injection quantity is applied to the injector 7, to cause the latter 7 to inject fuel, thereby to adjust the air/fuel ratio.

Now, a method of detecting a suction air quantity of each cylinder, and a method of controlling the air/fuel ratio and ignition timing thereof will be described.

In the embodiment, for each cylinder, the cylinder internal pressure is measured twice during the compression stroke, and the suction air quantity is detected from the difference between the two pressures thus measured.

Figure 8:
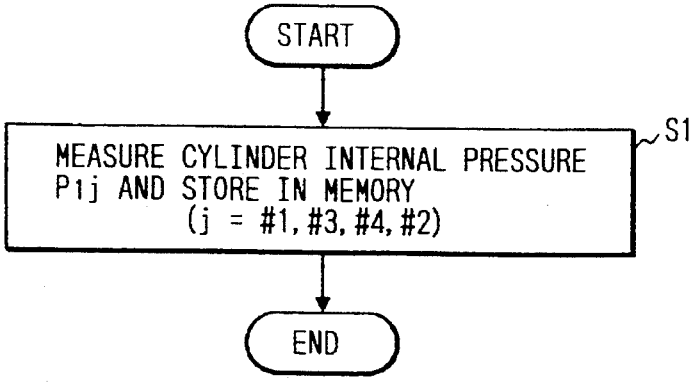
FIG. 8 is a flow chart showing a step of detecting a cylinder internal pressure with a predetermined crank angle.
Figure 9:
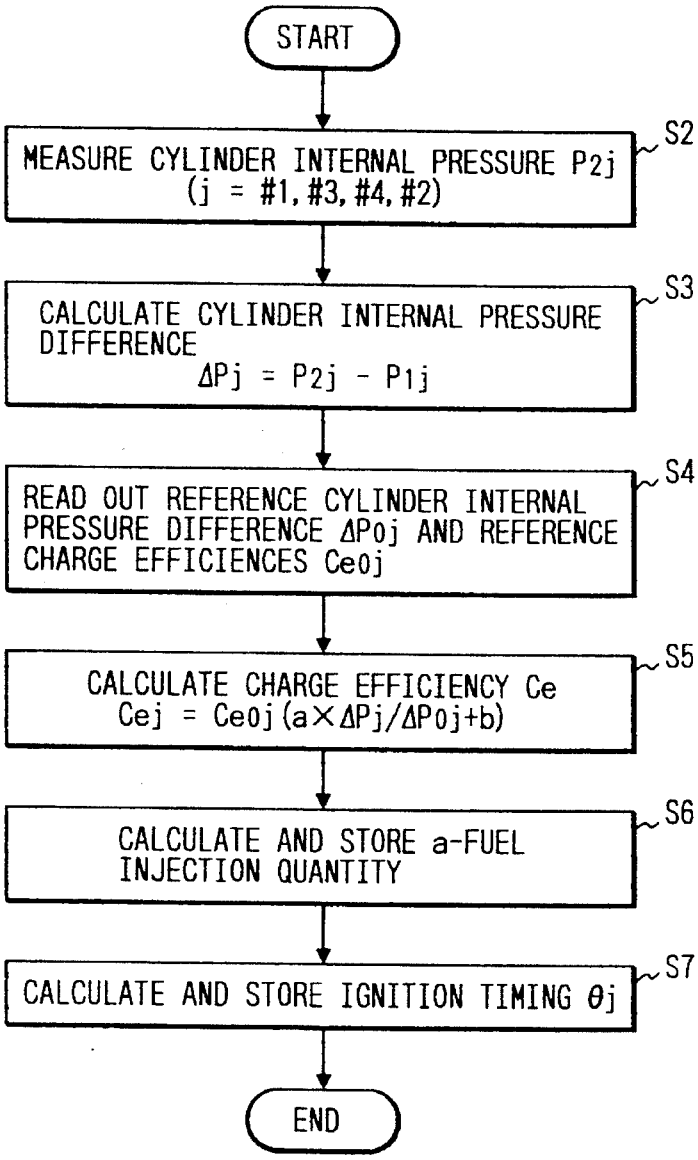
FIG. 9 is a flow chart showing steps of obtaining air/fuel ratios and ignition timing in the embodiment of the invention.

FIGS. 8 and 9 are flow charts for a description of the operation of the micro-computer 14 in the ECU 13.

In the operation of the suction air quantity, the cylinder identifying signal outputted by the crank angle sensor 11, and the unitary crank angle signal outputted by the crank angle sensor 10 are utilized to identify crank angles $\theta_1$ and $\theta_2$ in the stroke of compression stroke of each cylinder. With the crank angle $\theta_1$, an interrupt signal is produced in the micro-computer 14 through the input I/F 15, so that the flow of FIG. 8 is executed as an interrupt processing routine. Similarly, with the crank angle $\theta_2$, the flow of FIG. 9 is executed as an interrupt processing routine.

First, when the crank angle reaches $\theta_1$ (for instance BTDC 90°) during the rotation of the engine 1, the flow of FIG. 8 is executed. In Step S1, cylinder internal pressures P1j with the crank angle $\theta_1$ are measured with the output of the cylinder internal pressure sensors 8 applied through the input I/F 15 to the A/D converter in the micro-computer 14. The cylinder internal pressures are stored in memories P1#1, P1#3, P1#4 and P1#2 which are provided in the micro-computer 14 for the cylinders, respectively. The suffix letter "j" of "P1j" represents the cylinder numbers (i.e., j=#1, #3, #4 and #2). As was described with reference to FIG. 7, the compression strokes of the cylinders occur repeatedly with a phase difference of crank angle 180°. Therefore, the cylinder identifying signal of the crank angle sensor 10 is referred to, so that the cylinder internal pressure sensor 8 corresponding to the cylinder number represented by the signal is selected. The cylinder internal pressures P1j with the crank angle $\theta_1$ are subjected to analog-to-digital conversion, and stored in the aforementioned memories, respectively. Thus, the routine has been ended.

When the crank angle reaches $\theta_2$ (for instance BTDC 40°), the flow of FIG. 9 is executed. That is, in Step S2, cylinder internal pressures P2j with the crank angle $\theta_2$ are subjected to analog-to-digital conversion in correspondence to the cylinder numbers.

Next, in Step S3, cylinder internal pressure differences ΔPj are calculated according to the following Equation (3):

$$\Delta Pj=P2j-P1j \quad (3)$$

The suffix letter "j" of ΔPj represents the cylinder numbers, similarly as in the cases of Steps S1 and S2. The cylinder internal pressures P1j with the crank angle $\theta_1$, which have been measured for the cylinders in the routine of FIG. 8, are read from memory, and the cylinder internal pressure differences ΔPj are calculated.

Figure 10:
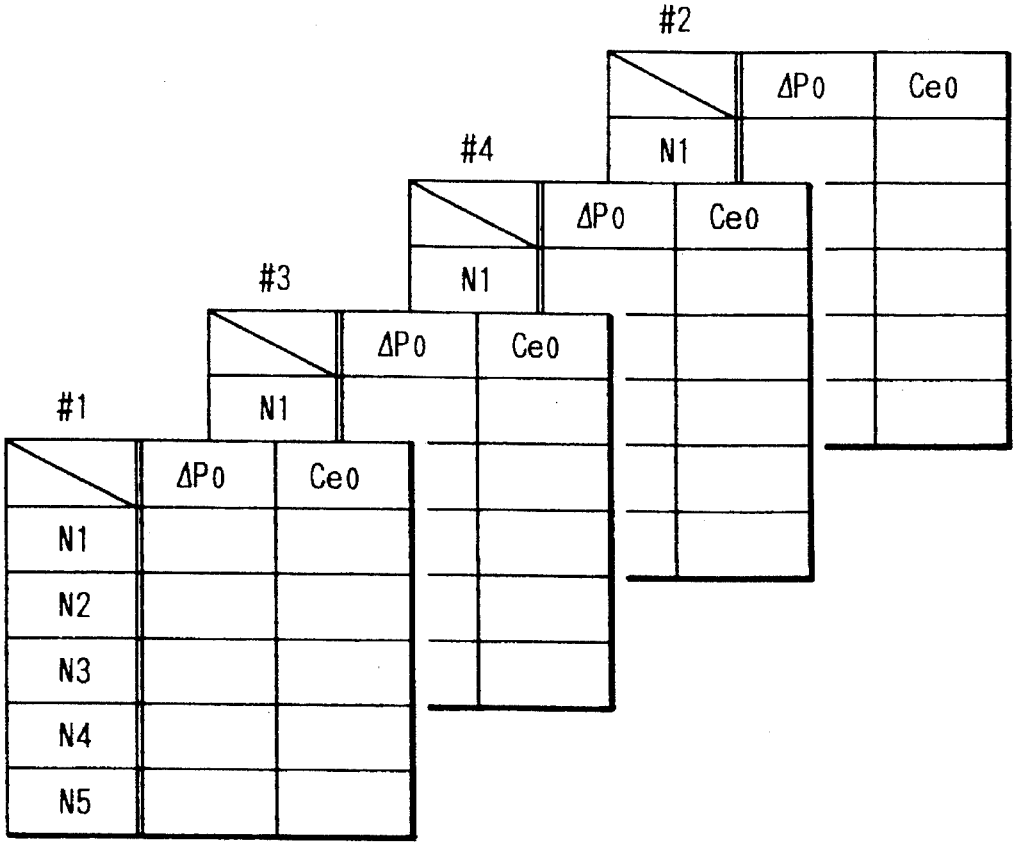
FIG. 10 is an explanatory diagram showing map tables provided for the cylinders of the engine, in each of which reference cylinder internal pressure differences and reference charge efficiencies with respect to engines speeds are stored.

Next, Step S4 is effected. In Step S4, reference cylinder internal pressures differences ΔPoj and reference charge efficiencies Ceoj are read from map tables (FIG. 10) provided in memory in the micro-computer 14. In each of the map tables, the vertical axis is divided into parts N1, N2, N3, . . . in correspondence to the speeds (rpm) N of the engine; that is, engines speeds N1, N2, N3, . . . are plotted on the vertical axis, while a reference cylinder internal pressure difference ΔPoj and a reference charge efficiency Ceoj are plotted on the vertical axis which are measured with a reference load (a suction pipe pressure of −300 mm Hg for instance) predetermined for every engine speed (rpm).

In the embodiment, the period of a predetermined angular interval of the crank angle sensor 11 is measured with the timer in the micro-computer 14 according to a certain procedure (not shown), to calculate the engine speed (rpm) N. In the map table, the vertical axis is retrieved according to an engine speed, so that the above-described reference values are read in correspondence to the current engine speed.

Thereafter, in Step S5, the charge efficiency Ce is calculated according to the following Equation (4):

$$Cej=Ceoj\ (a\times\Delta Pj/\Delta Poj+b) \quad (4)$$

The Equation (4) is obtained as follows: First, in the Equation (2), the reference charge efficiency Ceo is moved to the right side. And the cylinder internal pressure difference ΔPj calculated according to the Equation (3) in Step 3, and the reference cylinder internal pressure difference ΔPoj and the reference charge efficiency Ceoj provided with the engine operating under the normalized operating condition, which are read in Step S4, and the constants a and b experimentally obtained are inserted in the Equation (2) thus modified, to calculate the charge efficiency Cej.

The charge efficiency Cej thus calculated, and the engine speed N detected with the crank angle sensor, are used to determine an operating condition, which is utilized for calculating the air/fuel ratio and the ignition timing (described later).

In Step S6, an injector valve opening pulse width Tj with respect to a fuel injection quantity is calculated according to the following Equation (5):

$$Tj=Ki\times Cej\times Kaf\times Ke+Td \quad (5)$$

where Ki is the injector fuel discharge quantity conversion coefficient for converting a charge efficiency Ce into a pulse width corresponding to a fuel injection quantity in theoretical air/fuel ratio; Cej is the charge efficiency of each cylinder which is obtained in Step S5, Kaf is the air/fuel ratio correcting coefficient; Ke is the air/fuel ratio correcting coefficient for correcting an air/fuel ratio according to the output of the air/fuel ratio sensor 12; and Td is the injector operation idle time correcting value which is predetermined with respect to a battery voltage.

Figure 11:
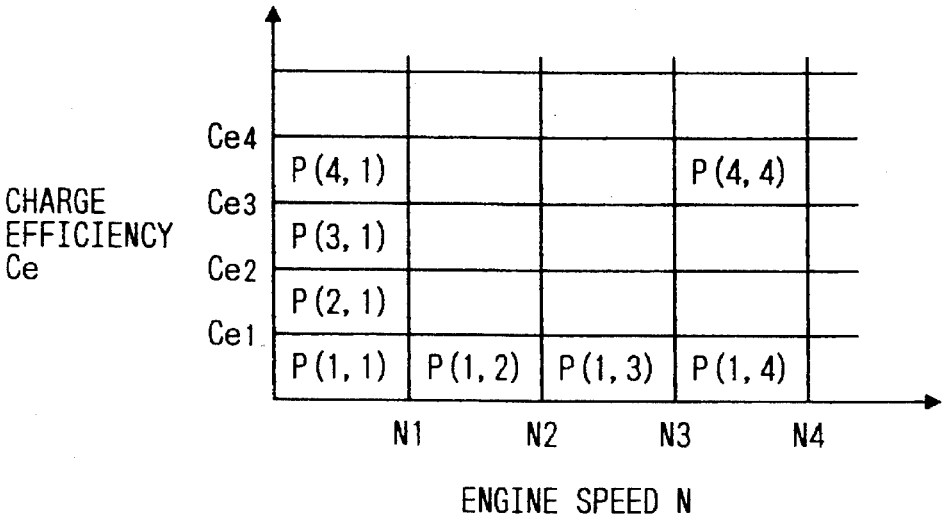
FIG. 11 is an explanatory diagram showing a map table for obtaining ignition timing from an engine speed and a charge efficiency in the embodiment of the invention.
Figure 12:
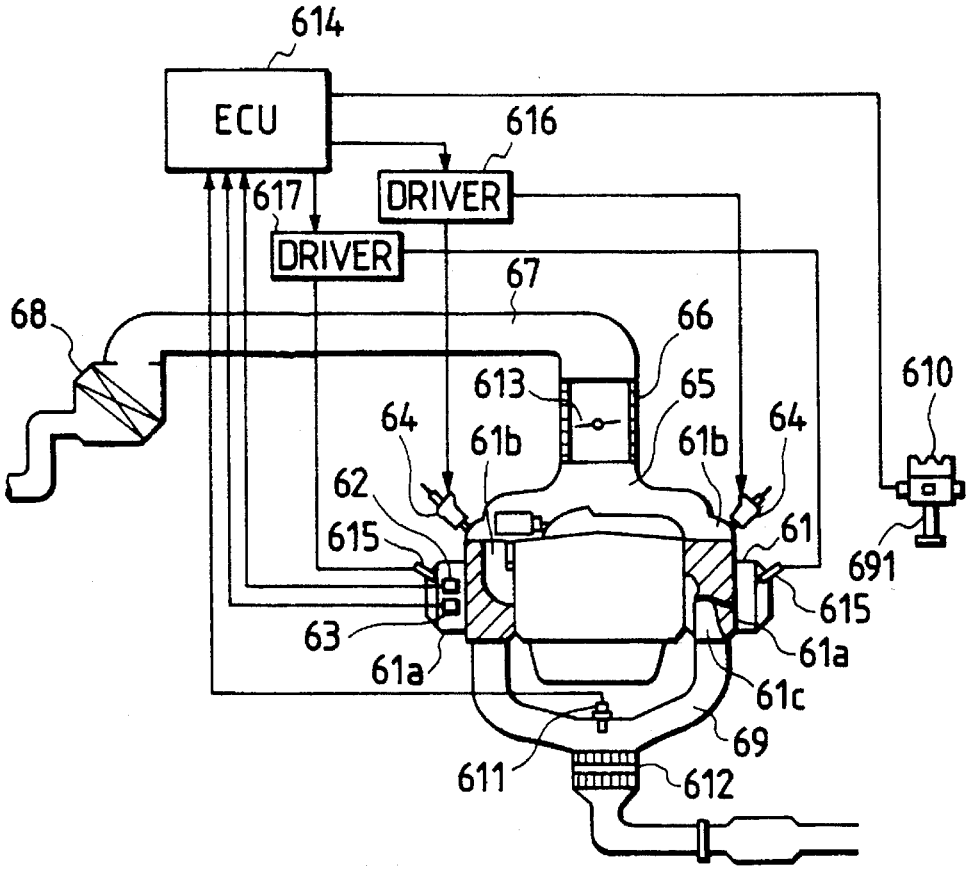
FIG. 12 PRIOR ART
FIG. 12 is an explanatory diagram showing the arrangement of a conventional engine control device.
Figure 13:
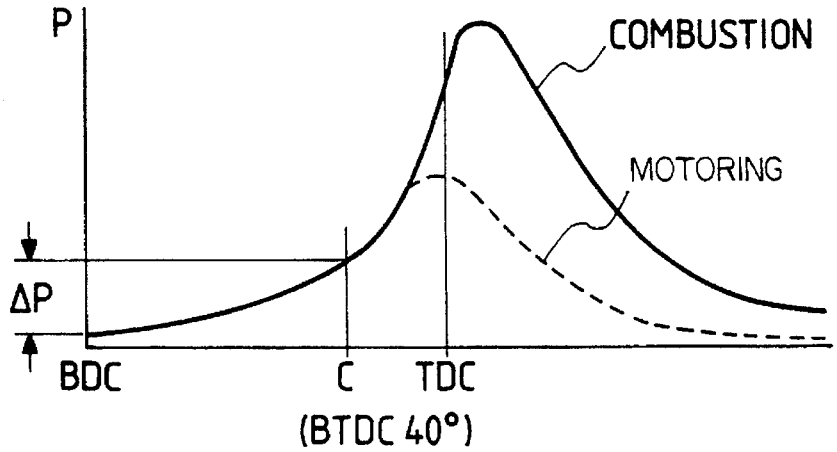
FIG. 13 PRIOR ART
FIG. 13 is a graphical representation for a description of the operation of the conventional engine control device.

Thereafter, Step S7 is effected. Ignition timing θj is read from a map table (shown in FIG. 11) stored in the micro-computer 14. In the map table, the vertical axis represents the charge efficiency Ce obtained in Step S5; that is, Ce1, Ce2, Ce3 . . . are plotted on the vertical axis; while the horizontal axis represents the engine speed N; that is, N1, N2, N3, . . . are plotted on the horizontal axis. The map table is divided into zones which are defined by the charge efficiencies Ce1, Ce2, . . . and the engine speeds N1, N2, . . . , and the ignition timing θj is assigned to a memory P(c,n) in a zone, where c and n are the zone numbers on the vertical axis and the horizontal axis, respectively. The most suitable ignition timing θj is read from the map table according to the operating condition of the engine 1 which is determined from the engine speed N and the charge efficiency Cej, and stored. Thus, the routine has been ended.

If summarized, in correspondence to the fuel injection quantity of each cylinder, the valve opening pulse width Tj of the injector 7, and the most suitable ignition timing θj are calculated in the above-described manner. As was described above, in the stroke of intake of each cylinder, the micro-computer 14 refers to the cylinder identifying signal and the ignition period signal of the crank angle sensor 11, to apply the valve opening time signal through the output I/F 16 to the injector 7 in correspondence to the valve opening pulse width Tj, to cause the injector to inject fuel, thereby to adjust the air/fuel ratio. On the other hand, in the stroke of compression of each cylinder, the micro-computer outputs a control signal through the output I/F 16 in synchronization with the aforementioned ignition timing θj to interrupt the application of current to the ignition coil (not shown) to induce a higher voltage therein. The high voltage thus induced is applied to the ignition plug 9 to ignite the gas in the cylinder.

In the first embodiment, in order to obtain the cylinder internal pressure difference ΔP, use is made of the cylinder internal pressures P1 and P2 at the two crank angles in the stroke of compression. However, the use of the pressures P1 and P2 may be replaced by the use of the average values of cylinder internal pressures detected with crank angles in predetermined range. That is, the difference between the average values may be employed as the cylinder internal pressure difference. In this case, disturbances such as noises can be eliminated, and therefore the charge efficiency can be calculated with high stability.

In the first embodiment, the charge efficiency is detected for each cylinder. The charge efficiency thus detected may be applied to a primary digital filter, or may be statistically processed, for instance averaged.

In the first embodiment, the engine speed detecting means measures the period between the predetermined crank angles detected by the crank angle sensor; however, the invention is not limited thereto or thereby. That is, for this purpose, the period of the ignition coil energizing signal may be measured.

In the first embodiment, in order to detect the load representing the operating condition of the engine, the charge efficiency is employed. However, instead of the charge efficiency, the degree of opening of the throttle valve, or the pressure of the suction pipe may be employed.

In the first embodiment, the charge efficiency is detected for each cylinder, and the charge efficiency thus detected is used to control the air/fuel ratio and the ignition timing of each cylinder; however, the invention is not limited thereto or thereby. That is, the value which is obtained by averaging the charge efficiencies of the cylinders, may be used for controlling the air/fuel ratio and the ignition timing. Furthermore, the first embodiment has been described with reference to the 4-cylinder engine; however, the invention is not limited thereto or thereby. That is, the technical concept of the invention may be equally applied to engines the number of cylinders of which is larger than or smaller than four, with the same effects.

As was described above, with the engine control device of the invention, the air/fuel ratios and the ignition timing are adjusted according to the cylinder internal pressures normalized by the pressure normalizing means. Hence, even when the engine operating condition changes, the values corresponding to the charge air quantities can be detected with high accuracy.

Furthermore, with the engine control device, the charge air quantities of the cylinders are detected, to control the air/fuel ratios and ignition timing of the cylinders separately. Hence, even when the quantities of air charged in the cylinders are different, the air/fuel ratios and the ignition timing can be controlled with high accuracy. Since the air/fuel ratios are controlled accurately, the exhaust gas is clean at all times, and the outputs of the cylinders are prevented from being fluctuated, which contributes to improvement of the combustion efficiency, and that of the fuel consumption.

Moreover, with the engine control device, the cylinder identifying crank angle detecting means operates to identify the cylinders, so that the adjustment of the air/fuel ratios and the ignition timing of each cylinder can be achieved with ease.

While there has been described in connection with the preferred embodiments of this invention, it will be obvious to those skilled in the art that various changes and modifications may be made therein without departing from the invention, and it is aimed, therefore, to cover in the appended claims all such changes and modifications as fall within the true spirit and scope of the invention.

What is claimed is:

1. A control device for controlling an engine having a plurality of cylinders, comprising:

crank angle detecting means for detecting predetermined crank angles of said engine;

cylinder internal pressure detecting means for detecting the internal pressures of said cylinders according to output signals provided by said crank angle detecting means;

pressure normalizing means for normalizing, according to a predetermined reference cylinder internal pressure, said cylinder internal pressures measured by said cylinder internal pressure detecting means;

engine speed detecting means for detecting a revolving speed of said engine;

means for obtaining values corresponding to charge air quantities of said cylinders by using an engine speed detected by said engine speed detecting means and said cylinder internal pressures normalized by said pressure normalizing means;

operating condition detecting means for detecting said values thus obtained and said engine speed as operating conditions;

calculation control means for calculating the air/fuel ratios and the ignition timing of said cylinders according to said operating conditions;

air/fuel ratio adjusting means for adjusting the air fuel ratio of said engine according to said air/fuel ratios calculated by said calculation control means; and ignition timing adjusting means for adjusting the ignition timing of said cylinders according to said ignition timing calculated by said calculation control means.

2. An engine control device as claimed in claim 1, which further comprises: cylinder identifying crank angle detector for generating a signal for identifying the cylinder number of an ignition cylinder.

3. An engine control device as claimed in claim 1, wherein said pressure normalizing means normalizes a cylinder internal pressure difference of cylinder internal pressures at two crank angles in a stroke of compression.

4. An engine control device as claimed in claim 1, wherein said pressure normalizing means normalizes a cylinder internal pressure difference of average values of cylinder internal pressures at two crank angles in a stroke of compression.

5. An engine control device as claimed in claim 1, wherein said charge air quantities obtaining means obtains charge efficiency for each cylinder.

6. An engine control device as claimed in claim 5, wherein said charge efficiency is subjected to a primary digital filtering processing or a statistically processing.

7. An engine control device as claimed in claim 1, wherein said engine speed detecting means measures a period between predetermined crank angles detected by said crank angle detecting means.

8. An engine control device as claimed in claim 1, wherein said calculation control means calculates the air/fuel ratios and the ignition timing of said cylinders based on charge efficiency.

9. An engine control device as claimed in claim 1, wherein said calculation control means calculates the air/fuel ratios and the ignition timing of said cylinders based on an average value of charge efficiency.

* * * * *